US012129070B2

(12) United States Patent
Negrini et al.

(10) Patent No.: US 12,129,070 B2
(45) Date of Patent: Oct. 29, 2024

(54) COUPLING DEVICE FOR COUPLING A COMPONENT TO AN ARTICLE

(71) Applicant: G.D S.P.A., Bologna (IT)

(72) Inventors: Vladi Negrini, Bologna (IT); Maria Eleonora Cesarini, Bologna (IT)

(73) Assignee: G.D S.P.A., Bologna (IT)

( * ) Notice: Subject to any disclaimer, the term of this patent is extended or adjusted under 35 U.S.C. 154(b) by 2 days.

(21) Appl. No.: 18/006,848

(22) PCT Filed: Jul. 26, 2021

(86) PCT No.: PCT/IB2021/056724
§ 371 (c)(1),
(2) Date: Jan. 25, 2023

(87) PCT Pub. No.: WO2022/029551
PCT Pub. Date: Feb. 10, 2022

(65) Prior Publication Data

US 2023/0271734 A1 Aug. 31, 2023

(30) Foreign Application Priority Data

Aug. 7, 2020 (IT) ..... 102020000019771

(51) Int. Cl.
*B65B 7/00* (2006.01)
*B65B 7/28* (2006.01)
(Continued)

(52) U.S. Cl.
CPC ..... *B65B 7/2878* (2013.01); *B65B 29/022* (2017.08); *B65B 43/50* (2013.01); *B65B 51/14* (2013.01); *B65B 57/08* (2013.01)

(58) Field of Classification Search
CPC ..... B65D 39/08; B65D 41/00; B67B 3/20; B67B 3/261; B67B 3/2033
See application file for complete search history.

(56) References Cited

U.S. PATENT DOCUMENTS 5,417,031 A * 5/1995 Bankuty ..... B67B 3/2033 53/331.5
8,375,683 B2 * 2/2013 Knieling ..... B65B 55/00 53/317
(Continued)

FOREIGN PATENT DOCUMENTS

CN 107856923 A 3/2018
CN 108438371 A 8/2018
(Continued)

OTHER PUBLICATIONS

International Search Report and Written Opinion for PCT/IB2021/056724 filed on Jul. 26, 2021 on behalf of G.D S.P.A. Mailed on Jan. 21, 2022. 16 pages.

*Primary Examiner* — Eyamindae C Jallow
(74) *Attorney, Agent, or Firm* — Steinfl + Bruno LLP

(57) ABSTRACT

A coupling device for coupling a component to an article includes a first retaining member that retains the component, a second retaining member that retains the article, a movement system for moving the first retaining member and the second retaining member between a non-operating position where the component and the article are spaced apart from one another, and an operating position where the component and the article are in a coupling position, and a detection system for detecting the positioning of the component on the first retaining member. The detection system includes an image detector device for capturing at least one image of the component when the component is retained by the first retaining member, and a processing unit provided for analysing the image captured by the image detector device and verifying if the component is retained on the first retaining member in a predefined position.

20 Claims, 6 Drawing Sheets

(51) Int. Cl.

| | |
|---|---|
| ***B65B 29/02*** | (2006.01) |
| ***B65B 43/50*** | (2006.01) |
| ***B65B 51/14*** | (2006.01) |
| ***B65B 57/08*** | (2006.01) |

(56) References Cited

U.S. PATENT DOCUMENTS

| | | | | |
|---|---|---|---|---|
| 9,623,990 | B2 | 4/2017 | Cirio | |
| 2003/0226616 | A1* | 12/2003 | Tawa | B67C 3/22 141/144 |
| 2005/0028487 | A1* | 2/2005 | Winters | B67B 3/2033 53/329 |
| 2009/0223169 | A1* | 9/2009 | Zanini | B67B 3/2033 53/317 |
| 2014/0305073 | A1 | 10/2014 | Monti | |
| 2014/0311256 | A1* | 10/2014 | Cochran | G01L 5/24 73/862.08 |
| 2017/0297752 | A1 | 10/2017 | Kogure et al. | |

FOREIGN PATENT DOCUMENTS

| | | | | |
|---|---|---|---|---|
| EP | 1205430 | A1 * | 5/2002 | B67B 3/2033 |
| EP | 3128323 | A1 | 2/2017 | |
| KR | 101950978 | B1 | 2/2019 | |

* cited by examiner

COUPLING DEVICE FOR COUPLING A COMPONENT TO AN ARTICLE

CROSS REFERENCE TO RELATED APPLICATIONS

The present application is the US National Stage of International Patent Application No. PCT/IB2021/056724, filed internationally on Jul. 26, 2021, which, in turn, claims priority to Italian Application No. IT 102020000019771, filed on Aug. 7, 2020.

The present invention relates to a coupling device, particularly configured for use in a packaging apparatus.

It is also directed to a packaging apparatus comprising such a coupling device as well as to a coupling method for coupling a component to an article.

The present invention has a preferred, though not exclusive, application in the field of packaging containers containing a slideable product, such as capsules containing food products and in particular food products for infusion type beverages, for example coffee. Reference will therefore be made below, without loss of generality, to the coffee capsule packaging sector.

Packaging apparatus comprising a filling unit, in which a plurality of empty containers is filled with coffee powder, and a subsequent closing unit, in which the coffee-filled containers are closed by a lid using a special coupling device, are known in this field.

These coupling devices generally comprise a retaining member to retain the container and a further retaining member to retain the lid, which can be moved one in relation to the other to bring the lid into contact with the container and thus enable them to be coupled together. In this description as well as in the accompanying claims, certain terms and expressions are deemed to have, unless otherwise expressly indicated, the meaning expressed in the following definitions.

The term "article" means any solid product which, within an industrial production line, can be removed, moved and deposited by a transfer device.

Within the scope of this description an article comprises a container, for example a container for coffee or other infusion type beverages, bottles and cartons of beverages, yoghurt pots, containers of solid, liquid or semi-solid food products; also, products of the ceramic industry, absorbent products for hygienic use, products of the tobacco industry, products of the cosmetics industry, products of the pharmaceutical industry, products of the personal & home care industry.

The term "container" means any receptacle apt to retain a product within it, in particular a slideable product such as a powder, liquid, gel or similar product, such as coffee powder, or infusion type substances.

In the context of this description, the term "slideable product" means a fluid, or granular, or powdery product such as a food powder such as coffee powder, a preparation for making infusion type beverages.

A "component" in this description may be any element apt to be coupled to an article, and in particular to a container, in any known manner, for example by welding. The component may be, within the scope of this description, a lid, or a generic container cover element, or even a label to be coupled to the container.

Within the scope of this description, the component is preferably two-dimensional.

A "cover element" is an element apt to close a mouth of the container, e.g. a lid of the membrane type, peelable, pierceable, or removable for access to the slideable product contained in the container.

The term "capsule" refers to a container with a lid, i.e. a ready-to-use packaging.

A "two-dimensional element" in the context of this description means an element having two of the three dimensions considerably larger than the dimensions of the third dimension, the latter being usually referred to as the thickness of the two-dimensional element.

An orientation is said "horizontal" when it is parallel to the ground plane in which the unit object of the invention is installed.

Consistently, the term "vertical" identifies a direction perpendicular to the horizontal plane. The Applicant, in the context of the constant need to increase the performance and efficiency of the packaging production lines, has preliminarily observed that, in a packaging line of articles, the correct coupling of the lid on the container can constitute an important limitation element of the production yield of the packaging line itself.

In fact, the Applicant has noted that this limitation element is mainly due to the fact that this operation is critical for obtaining the final product, since the capsules in which the lid is not correctly positioned on the container cannot be used and must, therefore, be discarded. The lid must be positioned on the container in such a way as to seal the mouth of the container to prevent accidental release of the product contained therein.

The Applicant also observed that the lid is usually formed directly at the coupling device, e.g. by cutting a strip by means of a punch. During the cutting step, the lid is retained in place by a retaining member which then brings it directly into contact with the container to be coupled, for example by welding.

However, the Applicant has verified that this coupling procedure is unsuitable for operation at high production speeds.

The Applicant has therefore realised that in order to increase the productivity of the process of coupling a lid to a container, it would be useful to subdivide the process of cutting the lid and coupling it to the container into separate steps.

The Applicant has therefore planned to obtain the lids in a cutting station and to then quickly transfer them to a coupling device to be coupled to the respective containers.

However, the Applicant has verified that the transfer of the lids from the cutting station to the coupling device involves passing them between several retaining devices and this, in itself, increases the likelihood of incorrect positioning of the lid on the container.

The Applicant also pointed out that the control of the position of the lid in the ready-to-fill capsules at the end of the packaging process is particularly costly in terms of time, equipment and resources employed, and often unreliable.

The Applicant has also noted that coupling the lids to the containers even when they are incorrectly positioned on the retaining member is, in fact, a waste of energy and resources as the finished capsule will necessarily be discarded due to the incorrect coupling.

The Applicant has therefore perceived that it would be particularly advantageous to be able to control the correct positioning of the lid on the coupling device before coupling it to the container.

The Applicant has finally found that the desired optimisation of the above mentioned processes is achieved by implementing a coupling device comprising a detector system to detect the correct positioning of the component before coupling it to the article, simplifying the detection operation and increasing the detection accuracy.

In particular, in a first aspect thereof, the invention relates to a device for coupling a component to an article.

Preferably, said coupling device comprises a first retaining member, provided to retain said component.

Preferably said coupling device comprises a second retaining member, provided to retain said article.

Preferably said coupling device comprises a movement system which is provided to move said first and said second retaining member between a non-operating position in which said component and said article are spaced apart from one another and an operating position in which said component and said article are in a coupling position.

Preferably said coupling device comprises a detection system for detecting the positioning of said component on said first retaining member.

Preferably said detection system comprises an image detector device, which is provided to capture at least one image of at least said component when said component is retained by said first retaining member.

Preferably, said detection system comprises a processing unit, provided for analysing said captured image captured by said image detector device and verifying if said component is retained on said first retaining member in a predefined position.

Thanks to this technical solution, the Applicant has found that it can control the position of said component on said retaining member in a precise, effective and well reproducible manner.

Furthermore, the Applicant has noted that this technical solution allows the position of said component on said retaining member to be controlled precisely and in a short time.

The Applicant has verified that this technical solution is suitable for effective use in packaging apparatuses working in continuous operation.

Even more, thank to this technical solution the Applicant is able to make a packaging machine, particularly one that works continuously, more efficient.

The Applicant has found that the proposed technical solution can considerably simplify the control of the position of an object.

In a second aspect thereof, the present invention relates to an article packaging apparatus comprising a movement carousel.

Preferably said movement carousel is provided with a plurality of coupling devices for coupling a component to an article.

Preferably each coupling device of said plurality of coupling devices is positioned in a peripheral position on said carousel.

Preferably each coupling device is made in accordance with the aforesaid first aspect. Thanks to this technical solution, the Applicant has ascertained that it can control the position of said component on said carousel in a precise, effective and well reproducible manner.

Thanks to this technical solution, the Applicant has also found that he can control the position of said component in an apparatus that operates continuously and without adversely affecting the operation of that apparatus.

In a third aspect thereof, the present invention relates to a method for coupling a component to an article.

Such a method preferably comprises retaining said component with a first retaining member.

This method preferably comprises retaining said article with a second retaining member. This method preferably comprises controlling the correct positioning of said component on said first retaining member.

This method preferably comprises moving said first and said second retaining members in order to put in contact said component and said article.

Such a method preferably comprises coupling said component and said article.

The Applicant has verified that, thanks to this technical solution, it is possible to determine when the coupling between article and component must be carried out fully and when it must be modified due to the incorrect positioning between article and component.

In a fourth aspect thereof, the present invention relates to a method for obtaining a contrasted image of two objects which are difficult to distinguish from one another in the visible range.

Preferably, this method involves differentiating the temperatures of the two objects. Preferably, this method involves capturing an image of the two objects in the infrared range. With this method it is possible to easily identify two objects that would otherwise be difficult to distinguish from one another in an image captured in the visible range, such as when the two objects are very similar in colouring and have no sharp contours.

Generally, the distinguishability or the no-distinguishability of two objects in the visible range is assessed at room temperature.

This method can be particularly useful in the field of image analysis, e.g. for quality control purposes.

As a particular and preferred application, it is possible to use this general method to accurately determine the relative position of two objects, e.g. to control if one or both objects are in a predetermined position. This application also includes, as a particular form of relative positioning, the possibility of controlling the presence or absence of one of the two objects.

In one embodiment the two objects are different components of the same article.

Preferably, this method involves, after having checked that the temperature difference between the objects is not sufficiently large, changing the temperature of one of them, preferably by heating it, before capturing the image in the infrared range.

Preferably, heating of either object can be achieved by radiation or conduction.

In one embodiment, both objects are subjected to radiation or conduction, their temperature differing due to their different heat capacity and/or thermal inertia.

In one embodiment, the temperature differentiation step of the two objects.

Preferably, the temperature difference between the two objects is such that they can be clearly distinguished in the infrared range. For example, this temperature difference may be a few degrees Celsius, more preferably a few tens of degrees Celsius.

An example of the application of this method can be identified in the field of packaging of canned products, such as foodstuffs or products for personal or domestic use, where it is envisaged that the box is packaged by a closed protection film and can be accessed by a user thanks to a special tear strip applied to the film itself.

In many cases, the protection film and the tear strip are made of different polymeric materials, but both are transparent, which makes it complicated to control on the line that the strip is present on the film at the end of the product canning step.

In this case, it is possible to heat the entire packaging for a certain time so that the film and the strip, having different thermal inertias, reach different final temperatures so that they are optically distinct in the infrared range and can therefore be easily identified in an image captured in the infrared range.

In addition, in a generalisation thereof, the method described above can become a method for obtaining a contrasted image of objects that are hardly distinguishable in the visible range at room temperature, where it is envisaged to heat one of the two objects up to a temperature that induces a colour change thereof and the acquisition of an image in the visible range.

Of course, in this case, the object heated at high temperature will be made of a material that can withstand this temperature without being damaged or significantly altered.

An application example of this further method can be identified in the production of articles in which it is provided for two components to be joined by thermal welding.

In this case it may be necessary to check the presence and/or correct positioning of one or both components with respect to a welding device. However, if both the welding device and the component whose position needs to be verified are made of materials with the same colouring at room temperature, e.g. of metal, it may be difficult to distinguish them in an image captured in the visible range at room temperature.

In this case, according to the method presented above, it is possible to heat one of the two objects, in particular the welding device, to a temperature high enough to change its colouring. In this way, even an image captured in the visible range can be sufficient to carry out the necessary verification of the presence and/or correct positioning of the component.

It will be noted that in order to vary its colouring, the welding device may be heated to a higher temperature than that required to carry out the welding operation for welding the components of the article and that this temperature may be reached even for a limited period of time suitable to carry out the image acquisition.

In at least one of the aforesaid aspects, the present invention may also have one or more of the preferred features described below.

Preferably, said first retaining member comprises a retaining surface on which said component is retained.

Preferably said retaining surface has a shape dependent on the shape of said component to be coupled.

This expedient allows improving the positioning accuracy of said component on said retaining surface.

Preferably, said retaining surface is smaller than the size of said component to be coupled. This expedient allows to make it easier and more accurate for the image detector to detect. Preferably, said coupling device comprises a welding device which is associated with said first retaining member.

The Applicant has verified that this expedient allows making the coupling step more precise.

Preferably, said welding device is configured to thermally weld said component to said article.

Preferably, said welding device comprises a welding head placed near said retaining surface.

The Applicant has verified that this expedient allows making the welding step more precise. The Applicant has verified that, thanks to this expedient, the efficiency of the apparatus can be increased, since the component is not subjected to substantial displacements between the detection by the detector device and the welding of the component on the article.

Preferably, said welding head is positioned, with respect to said retaining surface, opposite to said image detector device.

The welding head is preferably positioned so that said retaining surface is interposed between said welding head and said image detector device.

Preferably, when said component is retained in said predefined position on said first retaining member, said welding head is hidden from said image detector device by said component.

In one embodiment, said image detector device is configured to capture images in the visible range.

This technical solution has the advantage of further simplifying detection operations. Preferably said component is provided with a detection surface facing said image detector device having a different colouring than said retaining surface on which said component is retained.

Preferably said component is provided with a detection surface facing said image detector device having a different colouring than said welding head.

This expedient allows improving the accuracy of detection of the position of said component with respect to said retaining surface or with respect to said welding head by said detection system.

The Applicant has found that this technical expedient allows making the detection of the position of said component by the image detector device more precise, in particular when the image detector device operates in the visible range.

In one embodiment, at least one reference mark, more preferably a plurality of reference marks, is made on said retaining surface.

This expedient allows improving the accuracy of detection of said component by said image detector device.

Said at least one reference mark or said plurality of reference marks is preferably located on at least one peripheral zone of said retaining surface.

In one embodiment, said welding head is heated to a higher temperature than said component and, preferably, said image detector device is arranged to detect images in the infrared range of at least said component.

The Applicant has found that this technical expedient enables the correct position of the component on the first retaining member to be detected even when the component and the first retaining member have colorings that are difficult to distinguish from one another, without resorting to special markings in either of the two elements. This situation, however, occurs quite frequently, for example in all cases where the component is a lid formed by a membrane comprising, at least at its detection surface which is intended to face the inside of the container, a metal sheet, for example aluminium. In these cases, both the detection surface of the component and that of the first coupling member on which it is retained (typically made of steel) have a similar metallic colouring, which is not suitable for analysing the images detected, even and especially when illuminated by external light.

Providing, on the contrary an image detector operating in the infrared range, it is possible to effectively exploit the significant temperature difference between the welding head, which generally operates at a few hundred degrees, and the component, which is generally at room temperature. In this way, in the infrared range, the contrast between the image of the welding head and that of the component is sharp and it is therefore possible to precisely determine the position of the component with respect to the welding head, and consequently also with respect to the first retaining device, since the relative position between the welding head and the first retaining device is predetermined.

In the case where the welding head is smaller than the component and is substantially hidden behind the component when the latter is correctly positioned on the first retaining member, it can be observed that the determination of incorrect positioning is particularly easy. In fact, in this case, if the component is incorrectly positioned on the first retaining member, a portion of the welding head will be visible to the image detector device and, due to its high temperature, will produce on the captured image an area of high luminous intensity immediately identifiable by the control unit in charge of image analysis. This makes it possible to detect incorrect component positionings on the first retaining member with high accuracy.

It is pointed out that if, for any reason, the component were not present on the retaining surface at the time the image is captured, the welding head would be fully visible and, therefore, the position of the component would be identified as incorrect.

Preferably, said welding head is movable with respect to said retaining surface between a resting configuration in which said welding head is spaced away from said component and a welding configuration in which said welding head is approached to, or in contact with, a welding portion of said component and said component is coupled to said article.

Preferably said welding portion is provided in a peripheral portion of said component.

Preferably said welding portion is in the form of a circular crown.

The Applicant has ascertained that this technical expedient makes it possible to preserve the integrity of said component by avoiding subjecting it to high temperatures for long periods of time.

This also allows preventing unwanted overheating.

Preferably, said retaining surface has dimensions smaller than the dimensions of said component, so that said retaining surface retains said component in a central portion thereof and it is defined a peripheral portion of said component that is not in contact with said retaining surface.

Preferably said peripheral portion substantially corresponds to said welding portion. Preferably said component and said retaining surface are substantially circular in plan and said peripheral portion of said component is substantially shaped as a circular crown. The Applicant has ascertained that this technical expedient allows improving the adhesion of said component to said retaining surface and the detection of said component by the image detector device, in particular when operating in the visible range.

Preferably, said first retaining member comprises a suction device for generating a vacuum on said retaining surface and retaining said component on said retaining surface.

The Applicant has found that this expedient allows improving the accuracy of said coupling device by preventing unwanted displacements of said component on said retaining surface. Preferably, said image detector device is provided to capture at least one image of said component being retained by said first retaining member when said first retaining member is moved into said non-operating position.

This expedient allows simplifying the detection of said component by said image detector device and avoids steric interferences.

The Applicant has verified that, thanks to this expedient, the efficiency of the apparatus can be increased, since the component is not subjected to substantial displacements between the detection by the detector device and the welding of the component on the article. Preferably, said first retaining member comprises a first retaining element to retain a first component and a second retaining element to retain a second component.

This technical expedient allows increasing the efficiency of the coupling device, reducing the time needed for the coupling operation.

Preferably said coupling device is provided with a hinge pin around which at least one of said first and said second retaining member is rotatable to move said coupling device between said operating position and said non-operating position.

Preferably said first and said second retaining element are configured so that said first and said second component are mutually spaced in a radial direction of the movement trajectory of said first retaining element between said operating position and said non-operating position.

The Applicant has verified that this technical expedient allows avoiding interferences between the first and second retaining element and interferences in the detection of said first and said second component.

Preferably, said first and said second retaining element are configured such that said first and said second component are both oriented parallel to a vertical plane, more preferably said first and said second retaining element are coplanar.

Preferably said coupling device is movable along one transport direction.

Preferably said first and said second retaining element are configured such that said first and said second component are mutually spaced in a direction perpendicular to said transport direction of said coupling device.

This technical expedient allows avoiding that the provision of two different retaining elements for two different components on the same coupling device has a negative effect on the detection accuracy.

Preferably, said first and said second component in the non-operating position of said coupling device are spaced along a direction perpendicular to said transport direction of said coupling device.

The Applicant has experienced how this arrangement allows avoiding steric clutter or interferences in detection between said first and said second component.

Preferably, said first and said second component in the non-operating position of the coupling device are spaced along a vertical direction.

Preferably, said first and said second component are intended to be coupled on two separate articles.

Alternatively, said first and said second component are intended to be coupled on the same article.

Preferably, said image detector device is configured to obtain an image of said first and said second component to simultaneously detect the position of said first and said second component.

Thus, the detection times of the coupling device of the invention are reduced and, at the same time, a high detection accuracy is maintained.

The Applicant has verified that said technical expedient enables an efficient and rapid detection by the image detector device.

Alternatively, said image detector device is configured to detect an image of said first and said second component in a sequence.

Alternatively, said detection system comprises a first image detector device and a second image detector device that is distinct from said first image detector device, said first image detector device and said second image detector device being intended for detecting the position of said first and said second component, respectively.

This expedient allows increasing the detection accuracy while maintaining very short detection times.

Preferably, said second retaining device comprises a first retaining device for retaining a first article and a second retaining device for retaining a second article.

This technical expedient allows increasing the efficiency of the coupling device while avoiding interferences between the first and second retaining element.

Preferably, said movement system is configured to simultaneously move said first and said second retaining element between said non-operating position and said operating position. Preferably said coupling device is provided on a movement carousel which is intended to move said component and said article along a transport direction from a receiving station towards a coupling station in which said component is coupled to said article.

Preferably said carousel comprises a plurality of coupling devices positioned in a peripheral position on said carousel.

Preferably, said image detector device is provided on the outside of said carousel.

The Applicant has verified that this technical expedient allows a high detection accuracy to be maintained while avoiding interferences due to the movement of the carousel.

Preferably, said image detector device is provided in a position facing said coupling device, when said coupling device is in said non-operating position.

Alternatively, said image detector device is provided on said carousel and is arranged so as to face said coupling device when said coupling device is in said non-operating position. In this case, preferably, said image detecting device is movable with respect to said coupling device.

Preferably said image detecting device is movable with respect to said coupling device in a direction consistent with the transport direction.

Preferably, said image detecting device is provided on the outside of said carousel in a detection position interposed between a receiving position in which said component is loaded on said first retaining member and a coupling position in which said component is coupled to said article.

Preferably said second retaining member comprises a jaw for retaining said article. Preferably said second retaining member is configured so that a coupling surface of said article to which said component is to be coupled faces said component.

The Applicant has found that this technical expedient allows avoiding errors in the positioning of said component on said article.

Preferably, said controlling comprises detecting the position of said component on said retaining member by capturing an image of said component retained on said first retaining member and processing said image.

Preferably said method provides that said image is detected before said at least one of said first and said second retaining members are moved to bring said component and said article into contact.

The Applicant has verified that detecting the position of the component before moving it maximises the detection accuracy.

Preferably said detecting comprises sending a signal dependent on said processing and related to the detected position of said component.

Preferably said method comprises modifying said coupling based on said signal.

This technical expedient allows modifying the coupling step based on the result of said detection, i.e. based on said position of said component.

The Applicant has verified that this technical expedient allows optimising the coupling method.

Preferably said modification provides for simplifying the coupling step in case said signal indicates that said position of said component is not correct.

The Applicant has verified that this expedient allows energy savings.

Preferably, said coupling comprises thermally welding said component to said article.

In one embodiment, said detecting comprises capturing an image of said component in the visible range.

In one embodiment, said detection comprises providing a welding head having a surface temperature greater than the temperature of said component such that it is optically distinct from said component in the infrared range and, preferably, capturing an image of said component in the infrared range.

Preferably, on the basis of said signal it is provided for welding said component on said article on a continuous welding surface for a shorter time or on portions of said welding surface.

This makes it possible to simplify the welding process if a signal is emitted during the processing step indicating that said component is not in the correct position.

Preferably, said method comprises loading said component onto a conveying device, preferably of the rotating carousel type.

Preferably said method comprises loading said article onto said conveying device.

Preferably said method comprises conveying said component along a first conveying segment on said conveying device.

Preferably said method comprises conveying said article along a second conveying segment on said conveying device.

Preferably said coupling of said component to said article is provided when said component and said article are on said conveying device.

Preferably said detecting comprises detecting the position of said component on said conveying device along said first conveying segment.

The Applicant has noted that this technical expedient allows improving the accuracy of said detection step.

Preferably said detecting comprises simultaneously detecting an image of said first component and of said second component.

The Applicant has found that this technical expedient allows increasing the efficiency of the method.

In this way, the duration of the detection step is reduced and at the same time high detection accuracy is maintained.

The Applicant has verified that said technical expedient enables an efficient and rapid detection by the image detector device.

In one embodiment, said component is a two-dimensional component, such as a label, or a lid, preferably of the peelable, or perforable type.

In one embodiment, said article is a container, and in particular a container for a slideable product for obtaining an infusion type beverage.

In one embodiment, the coupling device comprises a gluing device for hot gluing said component and said article.

In one embodiment, the coupling device comprises a welding head of the ultrasonic type.

The characteristics and advantages of the invention will become clearer from the detailed description of an embodiment illustrated, by way of non-limiting example, with reference to the appended drawings in which.

Figure 1:
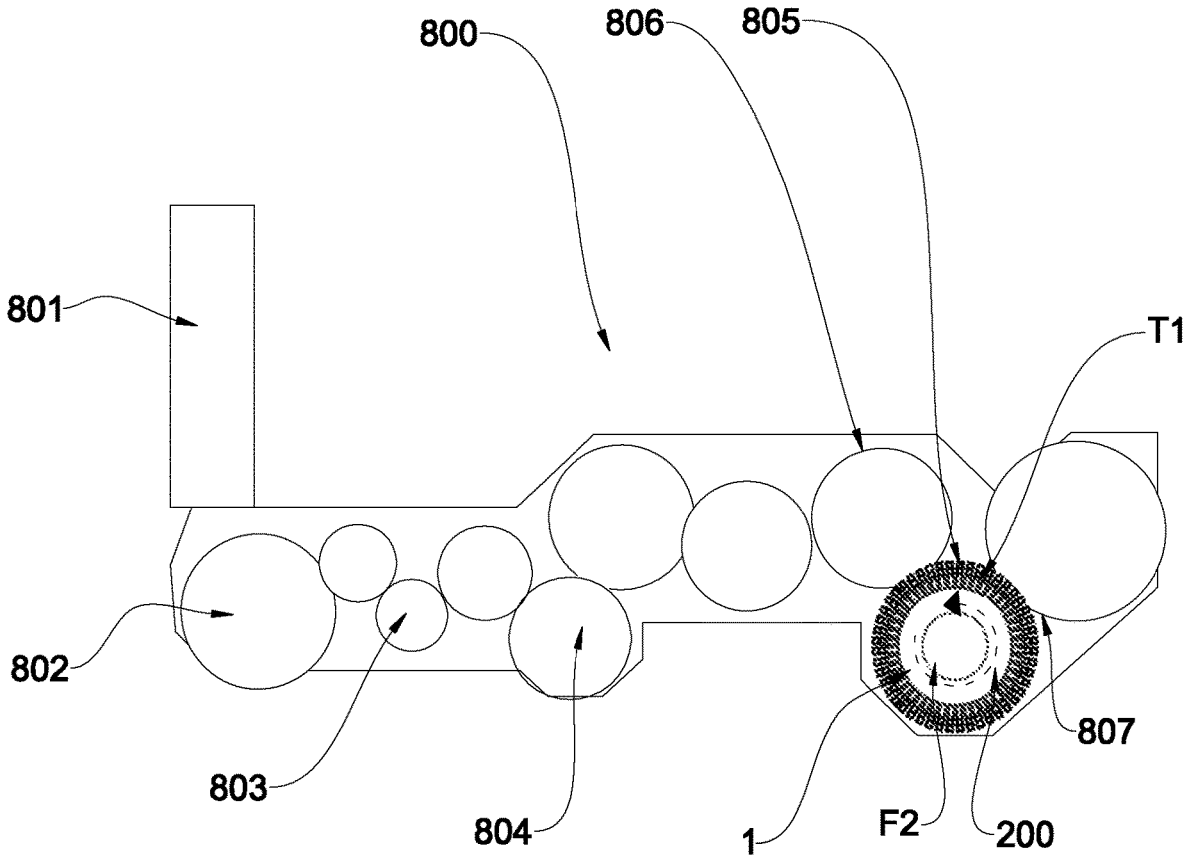
FIG. 1 represents a schematic view from above of an article packaging apparatus according to the present invention.
Figure 2:
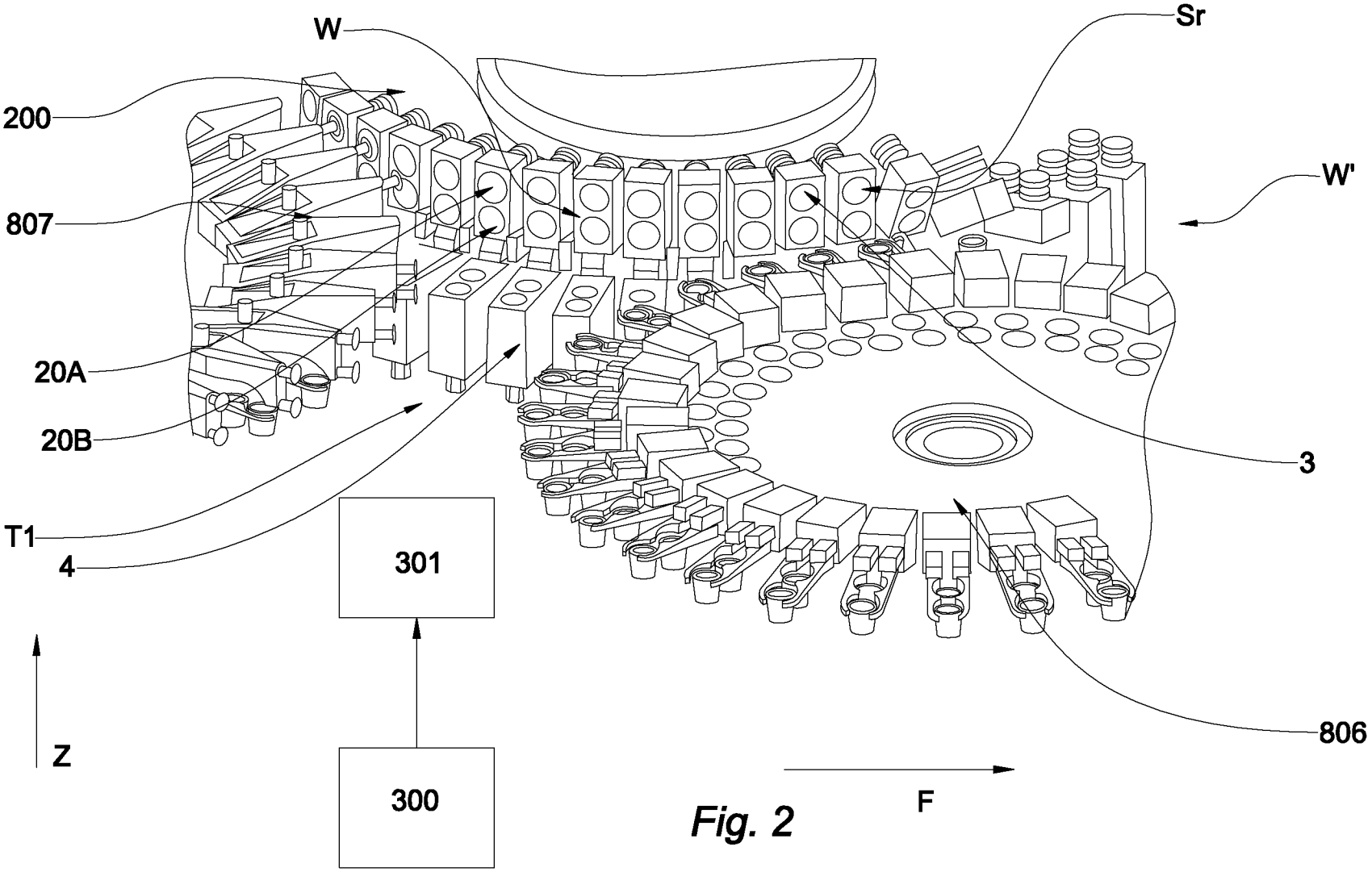
FIG. 2 is a schematic perspective view of a portion of the apparatus in FIG. 1.
Figure 3:
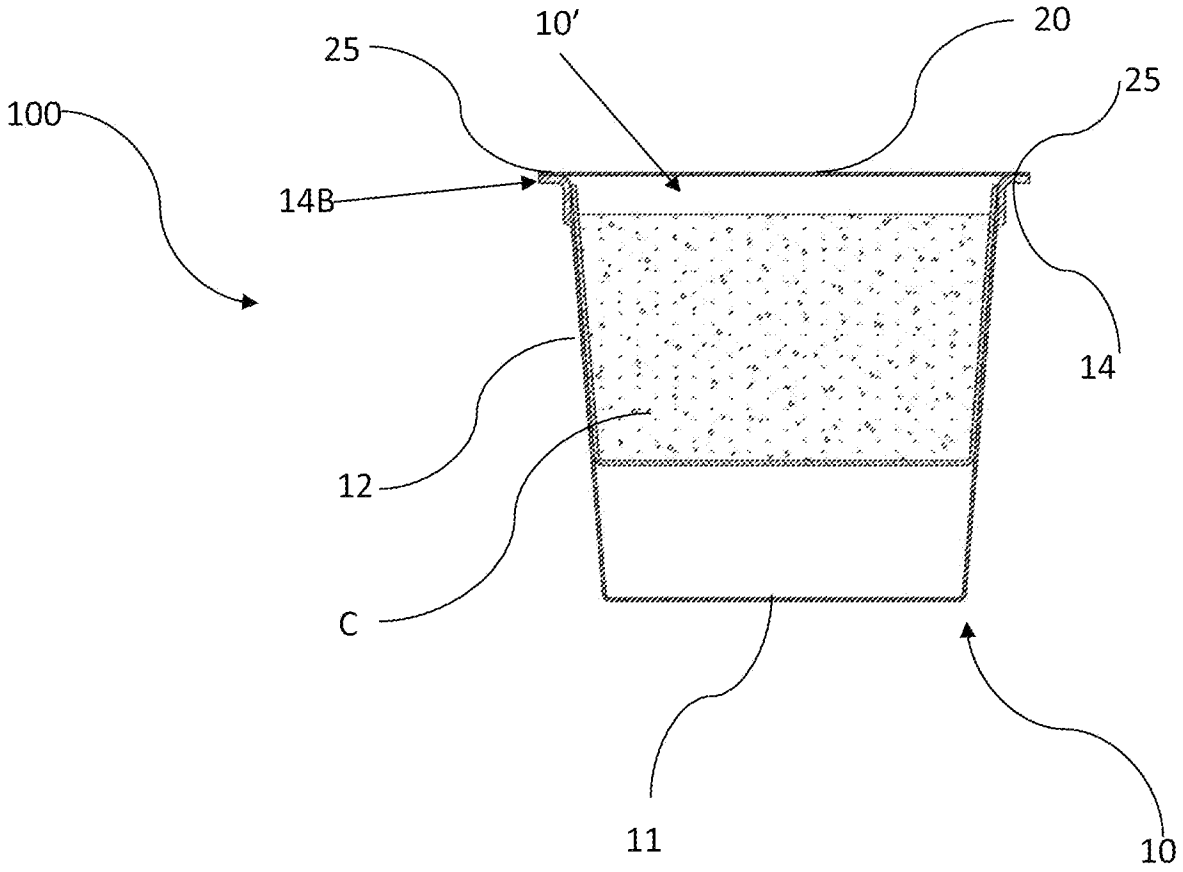
FIG. 3 represents a schematic sectional view of a capsule according to the present invention.

With initial reference to FIGS. 1 and 2, it is shown an article packaging apparatus 800 which is provided to produce a finished object 100 ready for packaging or use. The object 100, best visible in FIG. 3, is a coffee capsule and comprises a container 10 and a component 20 coupled to the container 10, as further described below.

Figure 2A:
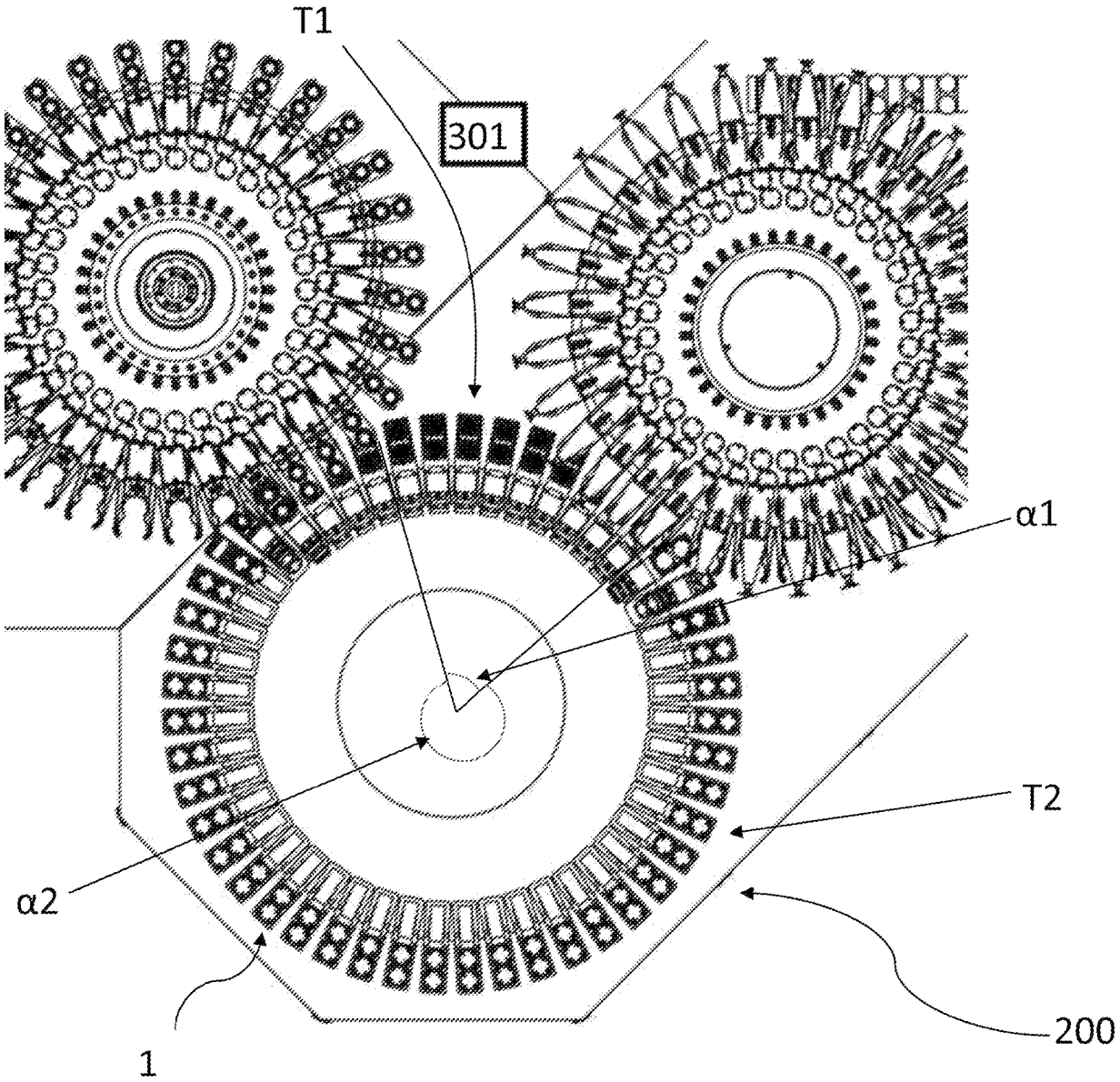
FIG. 2A is an enlarged detail of FIG. 1.

The production apparatus 800 comprises a feeding station 801, a shaping station 802 for shaping a filter, a welding station 803 for welding the filter to the container 10, a filling station 804 for filling the container 10 in which a slideable product is introduced into the container 10 and a coupling station 805 for coupling the component 20 to the container 10. The coupling station 805 comprises a conveying device 200, best visible in FIGS. 2 and 2A, on which a plurality of coupling devices 1 are housed, each coupling device 1 being intended to couple at least one component 20 to a container 10.

The conveyor device 200 is configured to transport the components and the containers in the movement direction indicated by arrow F towards an unloading carousel 807 after coupling a component 20 to a container 10.

The conveying device 200 is a rotating carousel, best visible in FIG. 2, rotating in the direction of rotation F2. The carousel 200 comprises 32 coupling devices 1 and is intended to receive a plurality of components and a plurality of containers and to mutually couple a component and a corresponding container.

Preferably, the plurality of retaining devices 1 is constrained on the rotating carousel 200 at its maximum circumference in such a way that it can facilitate receiving and delivery of containers and lids on and respectively from the rotating carousel 200.

The conveying device 200 is configured to receive the components 20 from a component shaping device not visible in the Figures and to transport them along a first conveying segment T1 corresponding to a first rotation angle $\alpha$1 of the carousel 200 equal to about 60°.

The conveying device 200 is configured to receive the containers 10 from an exchange wheel 806, placed downstream of the filling station 804, and to transport them along a second conveying segment T2 corresponding to a second rotation angle $\alpha$2 of the carousel 200 equal to about 300°, in which the coupling device 1 moves both the components 20 and the containers 10.

The coupling device 1 further comprises a detection system 300 arranged to detect the position of the components on the rotating carousel 200, as further explained below.

The example embodiment described below refers to containers 10 in the form of capsules filled with a desired slideable product, to which a component 20 is coupled.

In the specific case described herein, the containers 10 are capsule elements for the preparation of infusion type beverages, in particular coffee capsules, and the slideable product is coffee powder "C".

As better visible in FIG. 3, the container 10 is shaped to define a housing for a slideable product which is provided with a mouth 10' through which the slideable product is introduced into the container.

Preferably, the container 10 may be made of multilayer material, for example materials that are composed of layers of PP (Polypropylene) and/or EVOH (Ethylene Vinyl Alcohol) in PET (Polyethylene Terephthalate) or PS (Polystyrene). Alternatively, the container 10 is made of multilayer material with at least one metal alloy layer, e.g. aluminium-based.

In the example embodiment described herein, the component 20 is a lid made of polyamide material. In particular, the lid 20 may be a multilayer polymer in which there is at least one aluminium layer.

Preferably, on the side of the lid 20 facing in use towards the inside of the container 10 there may be a layer of adhesive material intended to melt and be joined to the container at the time of welding.

Preferably, on the outer side there may be a layer of a higher-melting material rather than the material on the inner side, which must not melt when heat is supplied to melt the layer arranged on the inner side.

The lid 20 is coupled to the mouth 10' of the container 10 and is shaped to close the mouth 10' by sealing the container 10 to prevent the slideable product from escaping from the container 10.

The lid 20 comprises a couplable portion 25 which is effectively heat-weldable to the container 10 also made, for example, of polymeric material.

In the present example and as represented in FIG. 3, the container 10 has a substantially inverted truncated conical shape presenting a base 11 of substantially flat and circular shape from which a lateral wall 12 is transversely projected. This lateral wall 12 is inclined with respect to the vertical line, presenting the smaller diameter thereof at the base 11 and the larger diameter thereof at an upper opening 13 defining the mouth 10' of the container 10.

The lateral wall 12 of the container 10 ends with an edge 14A radially projecting outwards from the container 10 itself and delimiting the mouth 10' of the container 10.

An abutment surface 14B is identified on this edge 14A and which is configured to realise a coupling area with the couplable portion 25 of the lid 20.

Preferably, the lid 20 is circular in shape and can be superimposed to the upper opening 13 of the container 10, the couplable portion 25 of the lid 20 is an annular portion that can be superimposed with the abutment surface 14B so that, by coupling the lid 20 to the container 10, the mouth 10' is closed and the container 10 is sealed.

Figure 4:
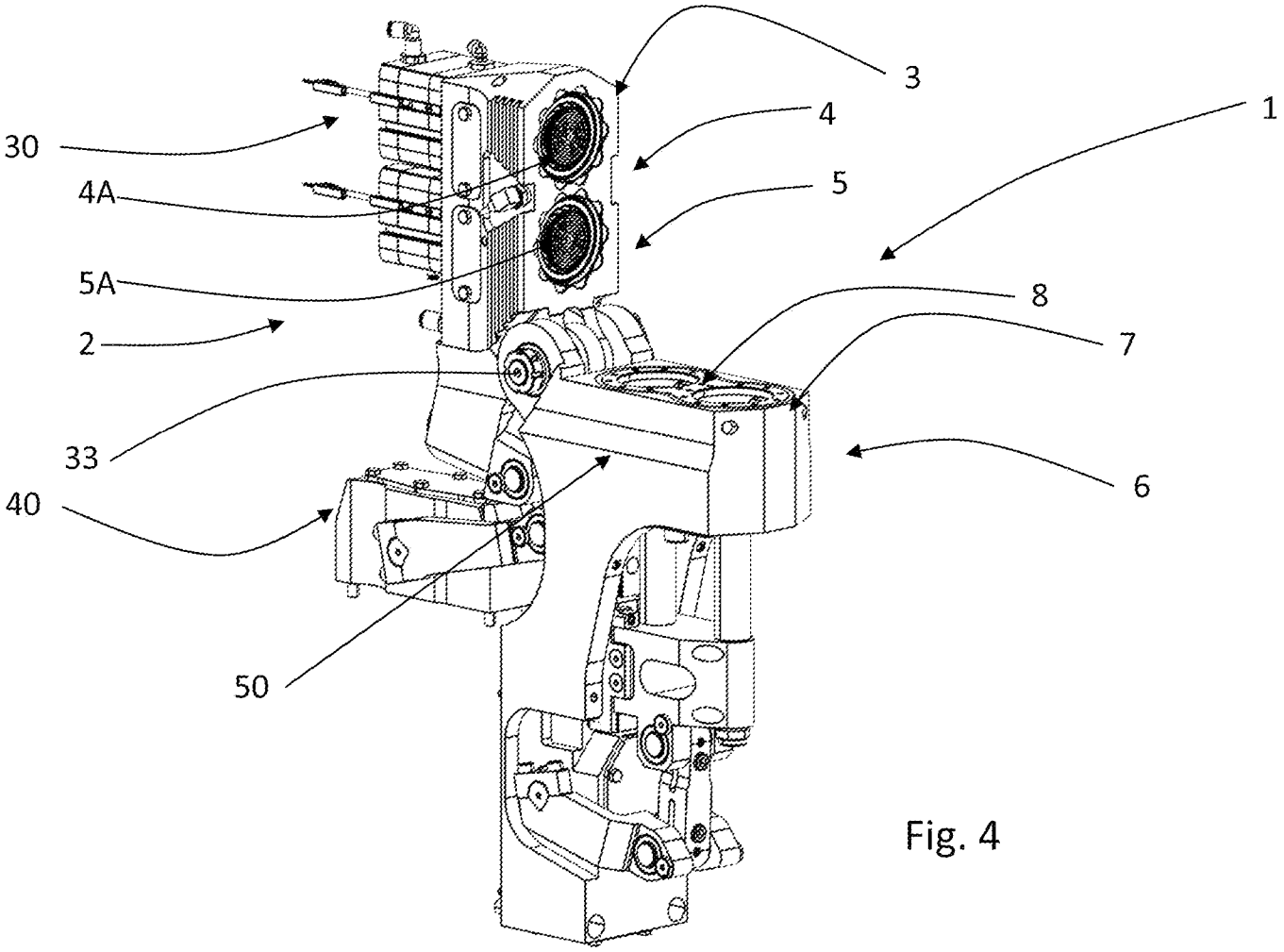
FIG. 4 is a schematic perspective view of a coupling device from FIGS. 1 and 2 in a non-operating position.
Figure 5:
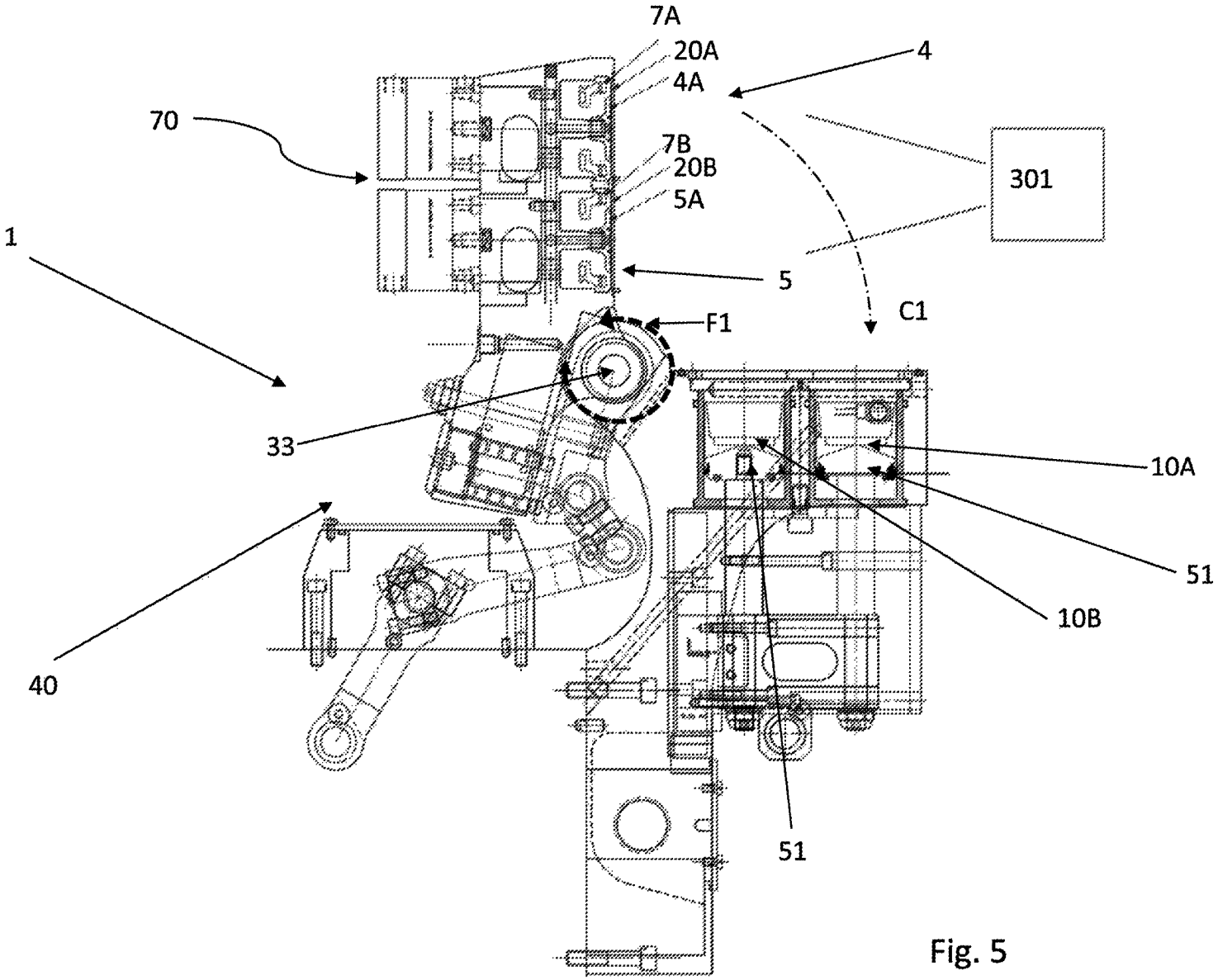
FIG. 5 is a sectional view of the device in FIG. 4 in a non-operating position highlighting an image detecting device.

With reference to FIGS. 4 and 5, a coupling device 1 for coupling the container 10 with the lid 20 provided on the carousel 200 is shown in greater detail.

The coupling device 1 comprises a frame 2 on which there is defined a first retaining member 3 for retaining at least one lid 20 and a second retaining member 6 for retaining at least one container 10.

The first retaining member 3 comprises a first retaining member 4 for retaining a first lid 20A and a second retaining member 5 for retaining a second lid 20B.

Similarly, in the version shown the second retaining member 6 comprises a first retaining device 7 for retaining a first container 10A and a second retaining device 8 for retaining a second container 10B.

Each of the first 7 and the second retaining device 8 is configured to define a seat 51 for housing the first 10A and the second container 10B, respectively.

The coupling device 1 further comprises a movement system 40, which is provided to move the first 3 and the second retaining member 6 between a non-operating position W in which the lids 20A and 20B and the containers 10A, 10B are respectively retained by the first 3 and the second retaining member 6 and are spaced apart from each other, and an operating position W' in which the lids 20A and 20B and the containers 10A, 10B are respectively retained by the first 3 and the second retaining member 6 in a close coupling position to couple a lid 20A, 20B to the respective container 10A, 10B.

The first 4 and the second retaining element 5 are configured to retain the lids 20A, 20B in a substantially aligned position.

The first 4 and the second retaining element 5 are configured to retain the lids 20A, 20B in the non-operating position W aligned along an axis perpendicular to the transport direction F of the carousel 200 or, in the version shown, in the vertical direction Z.

The first 4 and the second retaining element 5 are configured to retain the lids 20A, 20B are both oriented parallel to a vertical plane, more preferably the first and second retaining elements are coplanar.

The first 4 and the second retaining element 5 are integral so that they can be moved together.

The first 7 and the second retaining device 8 are integral so that they can be moved together.

The first retaining member 3 is movable between a non-operating position W, shown in greater detail in FIGS. 4 and 5, in which the retaining member 3 is oriented so that the first 4 and the second retaining member 5 can receive a respective lid 20A, 20B to be retained. Preferably, the non-operating position W is identified by a substantially vertical orientation of the retaining member 3.

From this non-operating position W, the coupling device 1 and in particular the first retaining member 3 is movable into an operating position W' in which the first retaining member 3 is rotated towards the second retaining member 6 so as to close the seats 51 and to bring the lid 20A, 20B into contact with the edge 14 of the respective container 10A, 10B.

The movement system 40 is configured such that the first retaining member 3 is rotatable about a rotation pin 33 along both directions of the rotation trajectory indicated by the arrow F1 in FIG. 5 to be moved between the non-operating position W' and the operating position W. The first retaining member 3 performs a curved trajectory Cl to reversibly move between the non-operating position W and the operating position W.

In the cases shown in the Figure such a curved trajectory Cl is preferably an arc of circumference substantially equal to 90°.

Alternatively, such a curved trajectory Cl can be an arc of an ellipse, or parabola, or further curved paths that can be achieved by means of linkages or cam mechanisms.

The movement system 40 is configured to move the first 4 and the second retaining element 5 simultaneously.

The movement system 40 is configured to rotate the first 4 and second retaining element 5 by about 90° between the non-operating position W and the operating position W'.

The first 7 and the second retaining device 8 are substantially identical, so they will be described together. Each retaining device 7, 8 is shaped to define a seat 51 constrained to the frame 2 and shaped to stably house the container 10A and the container 10B, respectively.

Each seat 51 comprises a cylindrical recess in which the container 10A, 10B is housed. The two seats 50 of the first 7 and the second retaining device 8 are preferably aligned according to a sagittal straight line of the coupling device 1.

In one embodiment, each retaining device 7, 8 may selectively retain the container 10A, 10B for example by means of a suction cup or similar systems in reduced pressure.

The first 4 and the second retaining element 5 are substantially identical, so they will be described together. Each retaining element 4, 5 of the first retaining element 3 is configured to selectively retain a lid 20A, 20B. Each retaining element 4, 5 comprises a retaining surface 4A, 5A arranged to receive and retain a respective lid 20A, 20B.

The first retaining member 3 is shaped so that the retaining surfaces 4A, 5A are aligned along a substantially vertical direction when the coupling device 1 is in the non-operating position W.

The first retaining member 3 is shaped so that the retaining surfaces 4A, 5A are substantially coplanar.

The retaining surfaces 4A, 5A have a shape dependent on the shape of the component to be coupled to the container. In the present case where the component to be coupled is a circular shaped lid 20A, 20B, the retaining surfaces 4A, 5A are substantially circular in shape.

Each retaining surface 4A, 5A preferably has a maximum diameter smaller than the maximum diameter of the lied 20A, 20B.

The first 4 and the second retaining element 5 are configured such that the lid 20A, 20B is retained by the retaining surfaces 4A, 5A at a central portion thereof.

Therefore, a peripheral portion not in contact with the retaining surface 4A, 5A is defined on each lied 20A, 20B.

Preferably, such a retaining surface 4A, 5A is a surface of a suction cup or similar retaining device.

The first 4 and the second retaining element 5 are operatively connected to a suction device, schematically indicated by 30, and shaped to create a desired reduced pressure on the retaining surfaces 4A, 5A to pick up and retain the lid 20A, 20B.

The coupling device 1 comprises a coupling element 70 which is a thermal welder intended to thermally weld the lid 20A, 20B to the respective container 10A, 10B.

Such a thermal welder 70 is intended to couple the lid 20A, 20B to the respective container 10A, 10B by heating the lid 20A, 20B so that it adheres to the edge 14A of the respective container 10A, 10B.

The welder 70 is preferably kept active and is translatable with respect to the first retaining device 3. When the coupling device 1 is in the non-operating configuration W, the welder 70 is placed at a desired distance from the lids 20A, 20B and in particular from their couplable portion 25 so as to avoid the possibility of overheating the lids 20A, 20B when they are secured to the respective retaining element 4, 5, before they are brought into contact with the respective container 10A, 10B.

Preferably, this predefined distance is between 1 mm and 10 mm.

When the coupling device 1 is brought into the operating position W', the welder 70 is displaced with respect to the lids 20A, 20B coming close, or in contact with, the coupling portion 25 of the lid 20A, 20B.

Alternatively, the welder 70 may be translated so as to protrude in the operating position W' externally from the retaining surface 4A, 5A so as to exert additional pressure on the coupling portion 25 during the coupling step.

The welder 70 is provided with a pair of welding heads 7A, 7B having a substantially circular crown shape and configured to be arranged in the operating position W radially external to each retaining surface 4A, 5A.

Each welding head 7A, 7B is shaped in such a way that it can be at least partially superimposed with the abutment surface 14B of the container 10 when the coupling device 1 is brought into the operating position W'.

Each welding head 7A, 7B is shaped in such a way that it can be at least partially superimposed with the coupling portion 25 of the lid 20A, 20B.

Each welding head 7A, 7B can also be moved and controlled independently of the other welding head of the thermal welder 70.

Preferably each welding head 7A, 7B and each retaining surface 4A, 5A are configured so that the welding head 7A, 7B surrounds the respective retaining surface 4A, 5A.

Preferably, the welder 70 is configured to apply a coupling temperature between 150° C. and 300° C. for a predetermined coupling time that is between 0.2 seconds and 0.8 seconds, preferably equal to 0.4 seconds.

Still preferably, the welder 70 exerts an even pressure on the coupling portion 25 between 45 and 85 Psi.

In operation, the first 4 and the second retaining element 5 of a coupling device 1 of the carousel 200 pick up two lids 20A and 20B from a lid shaping device to transport them, by means of the carousel 200, along the first conveying segment T1.

The first 7 and the second retaining device 8 of a coupling device 1 of the carousel 200 pick up two containers 10A 10B coming from the exchange wheel 806 to transport them, by means of the carousel 200, along the second conveying segment T2, together with the lids 20A, 20B.

In this joint conveying segment T2 the coupling device 1 is moved from the non-operating position W to the coupling operating position W', where the lids 20A, 20B are coupled to the respective containers 10A, 10B.

The coupling device 1 further comprises a detection system 300 arranged to detect the position of the lids 20A, 20B on the respective retaining surface 4A, 5A of the first retaining member 3.

The detection system 300 comprises an image detector device 301, schematically shown in FIGS. 2 and 5, arranged to capture at least one image of the lid 20A, 20B when it is retained on the respective retaining element 4, 5.

The detection system 300 further comprises a processing unit not visible in the Figures and arranged to analyse the image of the lid 20A, 20B captured by the image detector 301 and verify whether the lid 20A, 20B is retained on the respective retaining surface 4A, 5A in a predefined position.

The processing unit is configured to send a signal dependent on the processing of the detected position of the lied 20A, 20B.

Depending on the signal sent by the processing unit, it may be possible to modify the coupling step, as explained in more detail below.

The image detector device 301 is positioned to capture at least one image of the lid 20A, 20B when the coupling device 1 is in the non-operating position W.

The image detector device 301 is configured to simultaneously detect the position of the lids 20A, 20B which are retained on the first 4 and the second retaining element 5.

The image detector device 301 is positioned on the outside of the carousel 200, at the segment T1, in a fixed position facing the first retaining member 3 when the coupling device is in non-operating position W with the lids 20A, 20B already picked up by the first retaining member 3.

The image detecting device 301 obtains an image of the lids 20A, 20B positioned on the first retaining element 4 and the second retaining element 5.

In the preferred embodiment described herein, the image detector device 301 is an image detector configured to detect images in the infrared range.

In an alternative embodiment, the image detector device 301 can be configured to capture images in the visible range. In the latter case, each lid 20A, 20B may be provided with a detection surface Sr facing the image detector device 301 having a different colouring than the colouring of the corresponding retaining surface 4A, 5A on which the lid 20A, 20B and the welding head 7A, 7B are retained.

The relative positioning of the welding head 7A, 7B, the respective lids 20A, 20B and the image detecting device 301 is such that when the lid 20A, 20B is retained in the correct position on the respective retaining surface 4A, 5A, the respective welding head 7A, 7B is hidden from the image detecting device 301 by the lid 20A, 20B. Thus, in this case, no surfaces with a temperature particularly different from the lid temperature will be present in the image detected by the image detecting device 301, so that no regions with a brightness particularly different from the lid brightness will be present in the image.

Conversely, in the event that the lid 20A, 20B is improperly retained on the respective retaining surface 4A, 5A, a portion of the respective welding head 7A, 7B will protrude from the lid 20A, 20B resulting visible by the image detecting device 301. Thus, in this case, a high brightness region will be present in the image detected by the image detecting device 301 with respect to that corresponding to the lid (corresponding to the portion of the welding head that is at a much higher temperature than the lid). This makes it easy to identify the non-alignment of the lid with the welding head and, consequently, of the lid with the respective retaining element.

Of course, if, for any reason, the component 20A, 20B were not present on the retaining surface 4A, 5A at the time of image acquisition, the welding head would be fully visible and, therefore, the position of the component would be identified as incorrect.

This image analysis is carried out by the processing unit of the detection system 300. The processing unit emits a signal dependent on the result of the image analysis.

If the lid is correctly positioned, the signal sent by the processing unit includes accepting the final capsule obtained from the packaging apparatus 800.

If instead the lid is not correctly positioned, the processing unit sends a corresponding signal which envisages discarding the corresponding capsule at the end of the packaging operation.

In addition, if the lid is not correctly positioned, the processing unit may send a signal to change the coupling step.

In particular, it is possible to carry out a less precise welding for the lid which is not correctly positioned on the corresponding container, for example a spot welding or a welding with a shorter than normally expected application time.

In addition or as an alternative, welding at a lower temperature than the intended welding temperature may be envisaged.

At the end of the segment T2, the capsules 100 are unloaded from the carousel 200 and loaded onto an unloading carousel 807 through which they are transported to further processing stations provided in the apparatus 800.

In an alternative version of the image detector device not shown, the image detector device is configured to detect the image of the lid on the first retaining element and the image of the lid on the second retaining element in a sequence one after the other.

In an alternative version not shown in the Figures, the coupling device comprises a first image detector device and a second image detector device separate from the first image detector device. The first and second image detector devices are intended to detect the position of the lid on the first and second retaining element, respectively.

Alternatively, in a version not shown, the image detector device is provided on the carousel and is arranged to face the coupling device when the coupling device is in the non-operating position.

In an alternative version, the image detector device is positioned on a movement member in such a way that it can be moved relative to the coupling device, preferably in a manner concordant with the direction of transport of the coupling device.

It goes without saying that a person skilled in the art may, in order to meet specific and contingent application requirements, make further modifications and variants of the above-described invention within the scope of protection as defined by the following claims.

The invention claimed is:

1. A coupling device for coupling a component to an article, comprising:

a first retaining member for retaining said component, a second retaining member for retaining said article, a movement system for moving said first retaining member and said second retaining member between a non-operating position where said component and said article are spaced apart from one another, and an operating position where said component and said article are in a coupling position, and a detection system for detecting positioning of said component on said first retaining member, said detection system comprising:

an image detector device for capturing at least one image of at least said component when said component is retained by said first retaining member, and a processing unit provided for analysing said at least one image captured by said image detector device and verifying if said component is retained on said first retaining member in a predefined position, wherein said first retaining member comprises a retaining surface on which said component is configured to be retained and wherein said retaining surface includes at least one reference mark for detection accuracy of said component by said image detector device.

2. The coupling device according to claim 1, further comprising a welding device associated with said first retaining member for heat-welding said component to said article, said welding device comprising a welding head arranged close to said retaining surface.

3. The coupling device according to claim 2, wherein said welding head is positioned, with respect to said retaining surface, on an opposite side of said image detector device.

4. The coupling device according to claim 2, wherein said welding head is configured to be heated to a temperature greater than a temperature of said component, and said image detector device is configured to detect images of said at least said component in an infrared range.

5. The coupling device according to claim 1, wherein said image detector device is configured to capture images in the visible range.

6. The coupling device according to claim 5, wherein said component comprises a detection surface facing said image detector device and having a different colouring with respect to said retaining surface on which said component is retained.

7. The coupling device according to claim 1, wherein said first retaining member comprises a suction device for generating vacuum on said retaining surface and retaining said component on said retaining surface.

8. The coupling device according to claim 1, wherein said image detector device is configured to capture at least one image of said component retained by said first retaining member when said first retaining member is moved into said non-operating position.

9. The coupling device according to claim 1, wherein said first retaining member comprises a first retaining element for retaining a first component and a second retaining element for retaining a second component.

10. The coupling device according to claim 1, wherein said second retaining member comprises a first retaining device for retaining a first article and a second retaining device for retaining a second article.

11. An article packaging apparatus, comprising a movement carousel comprising at least one coupling device according to claim 1 for coupling a component to an article, the at least one coupling device being positioned in a peripheral position on said carousel.

12. The article packaging apparatus according to claim 11, wherein said image detector device is on an outside of said carousel in a position facing said coupling device when the at least one coupling device is in said non-operating position.

13. The coupling device according to claim 1, wherein said retaining surface is a planar surface.

14. A method for coupling a component to an article, comprising:

retaining said component by a first retaining member, retaining said article by a second retaining member, controlling correct positioning of said component on said first retaining member, moving at least one of said first retaining member and said second retaining member in order to contact said component and said article, and coupling said component with said article, wherein said first retaining member comprises a retaining surface on which said component is configured to be retained and wherein said retaining surface includes at least one reference mark for detection accuracy of said component by an image detector device.

15. The method according to claim 14, wherein said controlling comprises detecting a position of said component on said first retaining member by capturing an image of said component retained on said first retaining member and processing said image.

16. The method according to claim 15, wherein said detecting comprises providing a welding head having a surface temperature greater than a temperature of said component such that the welding head is optically distinct from said component in an infrared range, and capturing an image of at least said component in the infrared range.

17. The method according to claim 14, wherein said detecting also comprises sending a signal for modifying said coupling step on the basis of said signal.

18. The method according to claim 17, wherein, on the basis of said signal, said component is welded to said article i) on a continuous welding surface for a shorter time or ii) to portions of said welding surface.

19. The method according to claim 14, wherein said coupling comprises heat-welding said component to said article.

20. A method for obtaining a contrasted image of two objects difficult to distinguish from one another in a visible range, comprising:

differentiating temperatures of said two objects, and capturing an image of the two objects in an infrared range.

* * * * *